US006918376B2

(12) United States Patent
Oono et al.

(10) Patent No.: US 6,918,376 B2
(45) Date of Patent: Jul. 19, 2005

(54) FUEL SUPPLY DEVICE FOR AN INTERNAL COMBUSTION ENGINE

(75) Inventors: Takahiko Oono, Hyogo (JP); Akira Furuta, Tokyo (JP); Toshiaki Date, Tokyo (JP); Eiji Kanazawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/785,948

(22) Filed: Feb. 26, 2004

(65) Prior Publication Data

US 2004/0237938 A1 Dec. 2, 2004

(30) Foreign Application Priority Data

May 27, 2003 (JP) ..... 2003-149543

(51) Int. Cl.[7] ..... F02M 33/04
(52) U.S. Cl. ..... 123/458; 123/467
(58) Field of Search ..... 123/456, 457–459, 123/467, 198 DB

(56) References Cited

U.S. PATENT DOCUMENTS 4,782,808 A * 11/1988 Bostick et al. ..... 123/514
5,074,272 A * 12/1991 Bostick et al. ..... 123/514
5,159,911 A * 11/1992 Williams et al. ..... 123/467
5,537,980 A * 7/1996 Yamamoto ..... 123/447
5,711,274 A * 1/1998 Drummer ..... 123/456
5,785,025 A * 7/1998 Yoshiume et al. ..... 123/497
5,845,623 A * 12/1998 Blizard et al. ..... 123/467
6,408,825 B1 * 6/2002 Enoki et al. ..... 123/467
2004/0099248 A1 * 5/2004 Ito et al. ..... 123/457

FOREIGN PATENT DOCUMENTS

JP 11-125140 A 5/1999

* cited by examiner

*Primary Examiner*—Thomas Moulis
(74) *Attorney, Agent, or Firm*—Sughrue Mion, PLLC

(57) ABSTRACT

To provide a fuel supply device for an internal combustion engine including an ECU (22), in which, when the pressure in the fuel rail (2) is a high pressure greater than a maximum pressure (Pm) that can drive the injector (1) and the stopped engine (100), the ECU (22) opens the injector (1) to inject high pressure fuel in the fuel rail (2) into the stopped engine (100).

6 Claims, 8 Drawing Sheets

FUEL SUPPLY DEVICE FOR AN INTERNAL COMBUSTION ENGINE

BACKGROUND OF THE INVENTION

1. Field of the Invention

The present invention relates to a fuel supply device for an internal combustion engine, and more particularly to a fuel supply device for an internal combustion engine, which performs a fail-safe control for ensuring the restarting of the engine immediately after the engine is stopped with the pressure in the fuel rail being abnormally high.

2. Description of the Related Art

As disclosed, for example, in JP 11-125140 A, in a conventional fuel supply device, an injector is provided in the combustion chamber of each cylinder 27 of the engine, and while the injector is open, fuel in a fuel rail (common rail), which is a high pressure accumulation piping, is injected into the combustion chamber. A high pressure fuel pump is controlled by an electronic control unit so as to maintain the fuel sucked in from a fuel tank at a predetermined high pressure.

In the conventional fuel supply device, however, when the pressure in the fuel rail rises to an excessive degree due to malfunction of the high pressure fuel pump, etc., and the engine at rest, the maximum pressure allowing driving of the injector may be below the pressure in the fuel rail. Thus, when restarting of the engine is attempted immediately thereafter, it can happen that the injector is not driven and the engine cannot be started.

This will be illustrated in detail. When the pressure in the above-mentioned fuel rail rises to an excessive degree, the pressure control valve is opened, and fuel in the fuel rail flows to the low pressure side, whereby the pressure rise in the fuel rail is restricted. Thus, the pressure in the fuel rail is substantially equal to the opening pressure for the pressure control valve for a while. In order to cause fuel in the fuel rail to flow to the low pressure side, the opening pressure for the pressure control valve is normally set to be higher than the maximum pressure allowing driving of the injector. Thus, the pressure in the fuel rail is higher than the maximum pressure allowing driving of the injector for a while.

When an attempt is made to immediately restart the engine under this condition, large current flows through the starter and the battery voltage is reduced, resulting in a marked reduction in the maximum pressure allowing driving of the injector. The injector is a solenoid type electromagnetic valve, and the requisite drive energy for driving the injector is obtained by converting the electrical energy from the power source device of a vehicle-mounted battery, a vehicle-mounted generator, or the like to the magnetic energy. Thus, when the voltage of the battery is reduced, the drive energy is reduced accordingly, with the result that there is a fear of the maximum pressure allowing driving of the injector becoming lower than the pressure in the fuel rail.

Normally, the injector is designed so as to be driven at a pressure somewhat higher than the maximum pressure allowing driving thereof. However, when the pressure in the fuel rail rises to an excessive degree, the pressure control valve provided in the fuel rail is opened, and the fuel in the fuel rail flows to the low pressure side, with the result that the pressure in the fuel rail is a high pressure substantially equal to the opening pressure for the pressure control valve for a while. When the engine is restarted by the starter immediately thereafter, the maximum pressure allowing driving of the injector is reduced due to the reduction in the battery voltage, and there is a fear of this maximum pressure becoming lower than the pressure in the fuel rail and the injector not being driven, making it impossible for the engine to start.

Apart from the above-mentioned case in which the battery voltage is reduced, this also applies to a case in which the battery suffers deterioration, a case in which the pressure in the fuel rail rises to an excessive degree, etc.

SUMMARY OF THE INVENTION

The present invention has been made with a view toward solving the above problem in the prior art. It is an object of the present invention to provide a fuel supply device for an internal combustion engine which reliably causes the injector to be driven to enable the engine to restart even immediately after the engine is stopped with the pressure in the fuel rail risen to an excessive degree.

According to the present invention, there is provided a fuel supply device for an internal combustion engine including a control means for controlling an injector for injecting fuel in a fuel rail to control an amount of fuel to be injected into an engine, wherein, when the pressure in the fuel rail is a high pressure greater than a maximum pressure that can drive the injector and the engine is stopped, the control means opens the injector to inject the high pressure fuel in the fuel rail into the engine is stopped.

As a result, the pressure in the fuel rail is controlled, so that the pressure becomes lower than the maximum pressure allowing driving of the injector, making it possible to avoid a situation in which the injector is not driven.

DETAILED DESCRIPTION OF THE PREFERRED EMBODIMENTS

Embodiment 1

Figure 1:
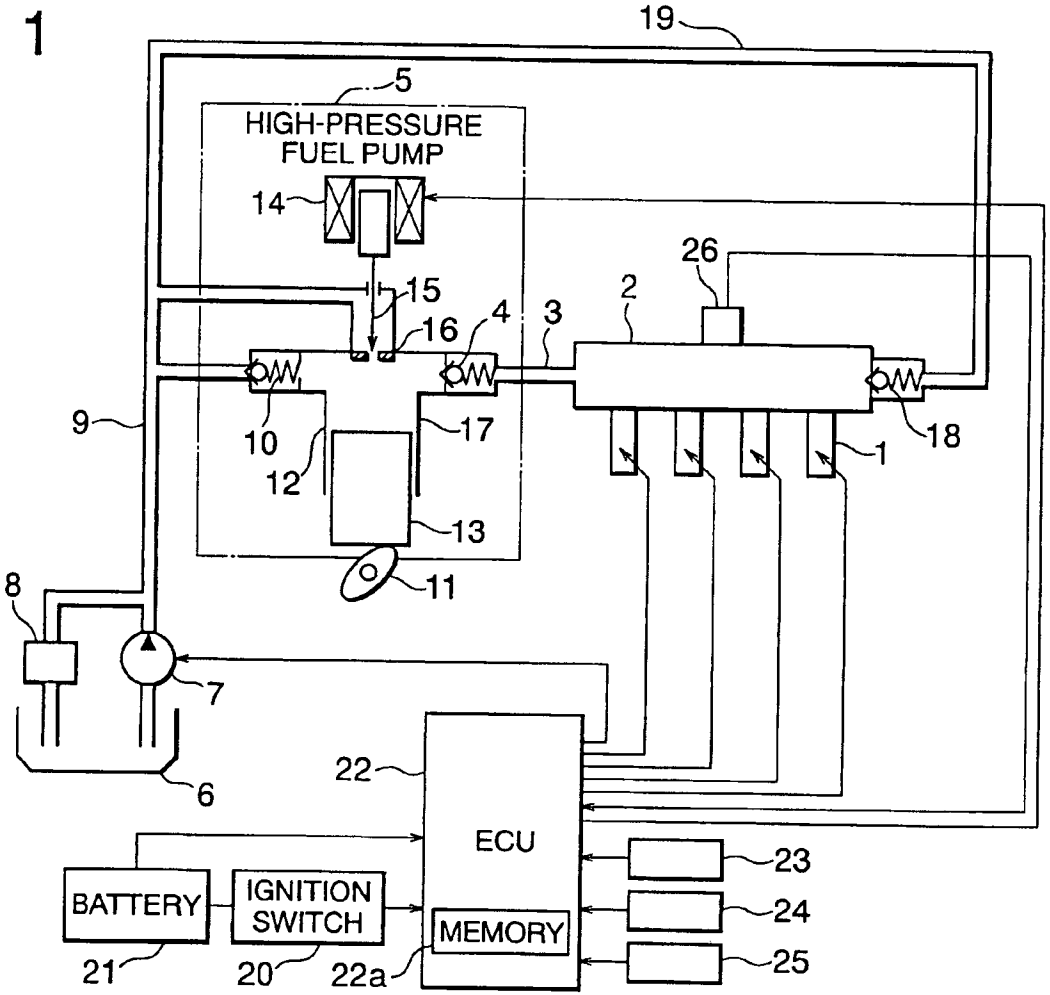
FIG. 1 is a schematic diagram showing a fuel supply device for an internal combustion engine according to Embodiment 1 of the present invention.
Figure 2:
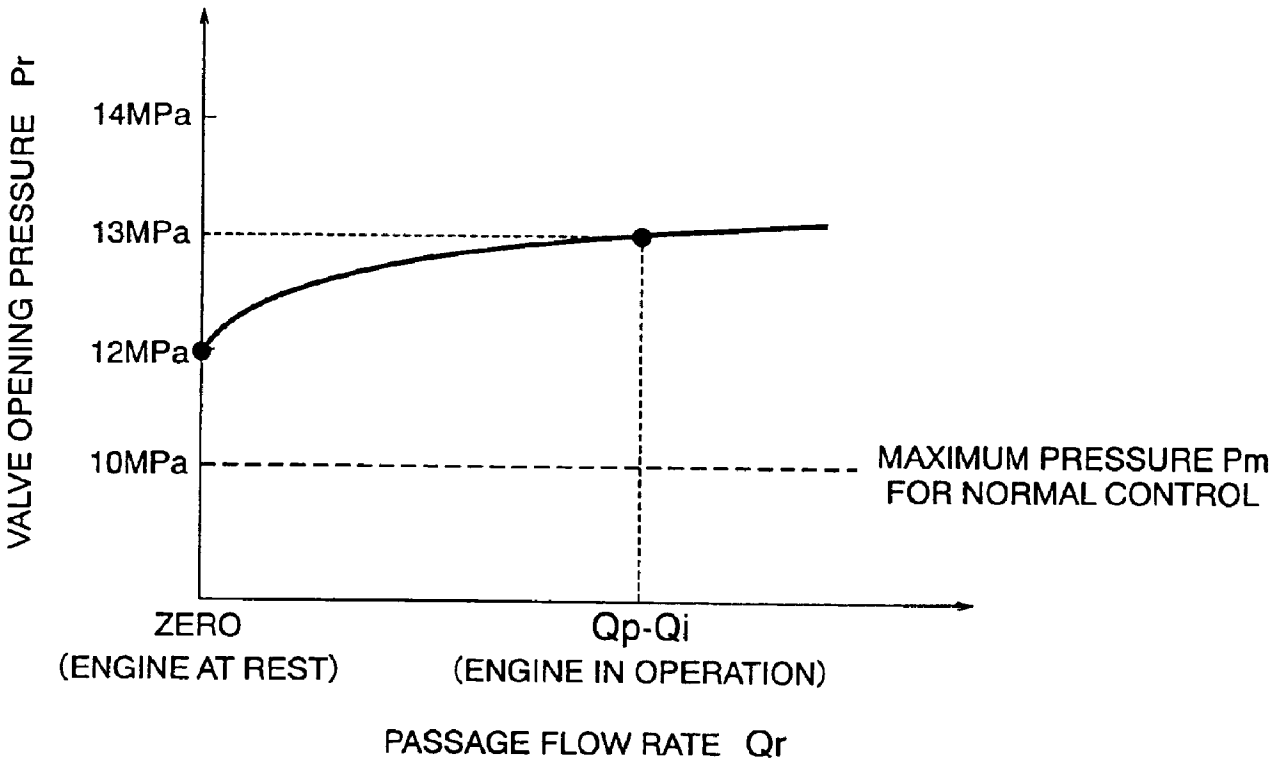
FIG. 2 is a diagram showing the relationship between the passage flow rate and the valve opening pressure in a pressure control valve included in the fuel supply device for an internal combustion engine according to Embodiment 1 of the present invention.
Figure 3:
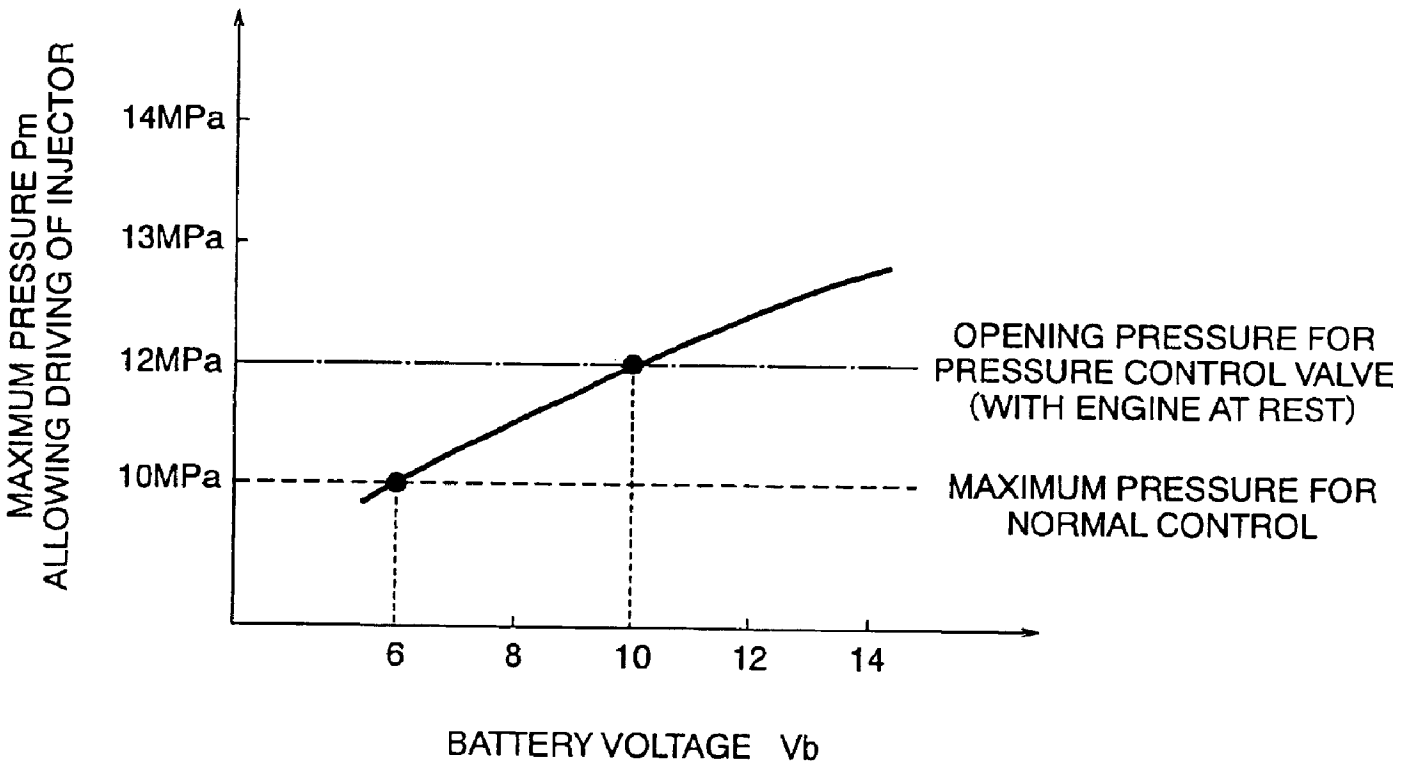
FIG. 3 is a diagram showing the relationship between the battery voltage and the maximum pressure allowing driving of the injector in the fuel supply device for an internal combustion engine according to Embodiment 1 of the present invention.

FIG. 1 is a schematic diagram showing a fuel supply device for an internal combustion engine according to Embodiment 1 of the present invention. FIG. 2 is a diagram showing the relationship between the passage flow rate and the valve opening pressure in a pressure control valve included in the fuel supply device for an internal combustion engine. FIG. 3 is a diagram showing the relationship between the battery voltage and the maximum pressure allowing driving of the injector in the fuel supply device for an internal combustion engine.

In FIG. 1, a plurality of injectors 1 are provided for each cylinder 27, and each injector 1 is connected to a fuel rail 2. The fuel rail 2 serves to accumulate high pressure fuel to be supplied to the engine 100, and is connected to a high pressure fuel pump 5 by way of a supply duct 3 and a check valve 4. A low pressure fuel pump 7 supplies fuel in a fuel tank 6 to the high pressure fuel pump 5 by way of low pressure piping 9 and a check valve 10. In effecting this supply, the fuel in the fuel tank 6 is adjusted to a predetermined low pressure by a pressure regulator 8. In the high pressure fuel pump 5, the pressure of the low pressure fuel supplied by the low pressure fuel pump 7 is raised to a predetermined the high pressure.

A cam 11 rotates in synchronism with the rotation of the crankshaft of the engine main body, and this rotation causes a piston 13 in a cylinder 12 to reciprocate.

A discharge amount control electromagnetic valve 14 is provided in the high pressure fuel pump 5 and is adapted to be opened with predetermined timing when fuel is to be supplied under pressure to the fuel rail 2 by the piston 13 (under-pressure supply process), controlling the amount of fuel supplied under pressure to the fuel rail 2. When the discharge amount control electromagnetic valve 14 is closed, fuel is supplied to the fuel rail 2 from a pump chamber 17, and the interior of the fuel rail 2 is constantly kept at a desired pressure. Note that the fuel supplied to the fuel rail 2 is supplied from the high pressure fuel pump 5 by way of the check valve 4 and the supply duct 3.

When the piston 13 makes a backward movement, with the valve member 15 and a valve seat 16 of the discharge amount control electromagnetic valve 14 being spaced apart from each other, the fuel supplied by the low pressure fuel pump 7 is supplied to the pump chamber 17. When the piston 13 makes a forward movement, with the valve member 15 and the valve seat 16 of the discharge amount control electromagnetic valve 14 being in contact with each other, the fuel supplied by the low pressure fuel pump 7 is pressurized in the pump chamber 17.

A pressure control valve 18 is mounted to an end portion of the fuel rail 2. One side (low pressure side) of the pressure control valve 18 is connected to the low pressure piping 9 by way of a low pressure passage 19. The pressure control valve 18 is opened when the pressure in the fuel rail 2 becomes excessively high (when it attains a high pressure not lower than a predetermined pressure). When the pressure control valve 18 is opened, the fuel accumulated in the fuel rail 2 is returned to the low pressure piping 9 by way of the low pressure passage 19.

FIG. 2 shows the relationship between the valve opening pressure Pr of the pressure control valve 18 and the flow rate of the fuel passing through the pressure control valve 18 (hereinafter referred to as "passage flow rate") Qr. According to FIG. 2, the valve opening pressure Pr increases as the passage flow rate Qr increases. Assuming that the discharge amount of the high pressure fuel pump 5 is Qp and that the injection amount of the injector 1 is Qi, the relationship: "Qr=Qp−Qi" holds true. When the engine 100 is in operation, fuel passes through the pressure control valve 18 at the flow rate of Qr, and the valve opening pressure Pr at this time is 13 MPa. When the engine 100 is stopped, the discharge amount Qp and the injection amount Qi are zero, and at this time (when Qr=0), the valve opening pressure Pr is 12 MPa. This valve opening pressure Pr (12 MPa) when the stopped engine 100 is higher than the maximum pressure Pm (e.g., 10 MPa) allowing driving of the injector 1 (hereinafter generally referring to each injector 1) controlled by an ECU 22.

An ignition switch (starting device) 20, which serves to stop or start the engine 100, is operated by power supplied from a battery 21.

The electronic control unit (hereinafter referred to as "ECU") 22 serves to control the general operation of the fuel supply device for an internal combustion engine, and is equipped with a memory 22*a*. The memory 22*a* stores a predetermined pressure in the fuel rail 2. This predetermined pressure is the maximum pressure Pm allowing driving of the injector 1 controlled by the ECU (control means) 22.

The ECU 22 inputs information regarding the engine RPM, the engine load, etc. based on signals from a cylinder discriminating sensor 23, a crank angle sensor 24, and a load sensor 25. The ECU 22 outputs a control signal to the injector 1 according to the operating condition of the engine 100 to thereby control the injector 1. This makes it possible to perform control so as to optimize the fuel injection timing and the fuel injection amount according to the operating condition of the engine 100.

Further, the ECU 22 outputs a control signal to the discharge amount control electromagnetic valve 14 based on signals from the crank angle sensor 24, the load sensor 25, and a fuel pressure sensor 26. This makes it possible to control the timing of energizing the discharge amount control electromagnetic valve 14, to control the fuel discharge amount in the high pressure fuel pump 14 and to maintain the fuel rail 2 at an optimum pressure (negative feedback control of pressure). Note that the fuel pressure sensor 26 is arranged in the fuel rail 2.

More specifically, the ECU performs the following control operations. When there is a balance between the discharge amount Qp of the high pressure fuel pump 5 and the injection amount Qi of the injector 1, a fixed pressure is maintained in the fuel rail 2. When the pressure in the fuel rail 2 is to be increased in this condition, the ECU 22 performs control such that the period of time in which the valve member 15 of the discharge amount control electromagnetic valve 14 is in the closed state is lengthened (i.e., such that the energization time for the discharge amount control electromagnetic valve 14 is lengthened). By this control,the period of time in which the pump chamber 17 and the supply duct 3 are in communication with each other is lengthened when fuel is supplied under pressure by the high pressure fuel pump 5. Thus, the amount Qp of fuel discharged from the high pressure fuel pump 5 increases, with the result that the pressure in the fuel rail 2 increases. In contrast, when the pressure in the fuel rail 2 is to be lowered during fuel supply under pressure, the ECU 22 performs control such that the energization time for the discharge amount control electromagnetic valve 14 is shortened. Thus, the amount Qp of fuel discharged from the high pressure fuel pump 5 is reduced, with the result that the pressure in the fuel rail 2 decreases.

Upon receiving a signal from the battery 21, the ECU 22 detects the voltage of the battery 21 (hereinafter referred to as "battery voltage"). FIG. 3 shows the relationship between the battery voltage Vb and the maximum pressure Pm allowing driving of the injector controlled by the ECU 22.

According to FIG. 3, the maximum pressure Pm allowing driving of the injector 1 decreases as the battery voltage Vb decreases. For example, when the batter voltage Vb is 10 V, the maximum pressure Pm is 12 MPa, and when the battery voltage Vb is 6 V, the maximum pressure Pm is 10 MPa. Thus, there occurs a situation in which, due to a reduction in the battery voltage Vb, the valve opening pressure Pr (12 MPa) when the stopped engine 100 is higher than the maximum pressure Pm allowing driving of the injector 1.

Figure 4:
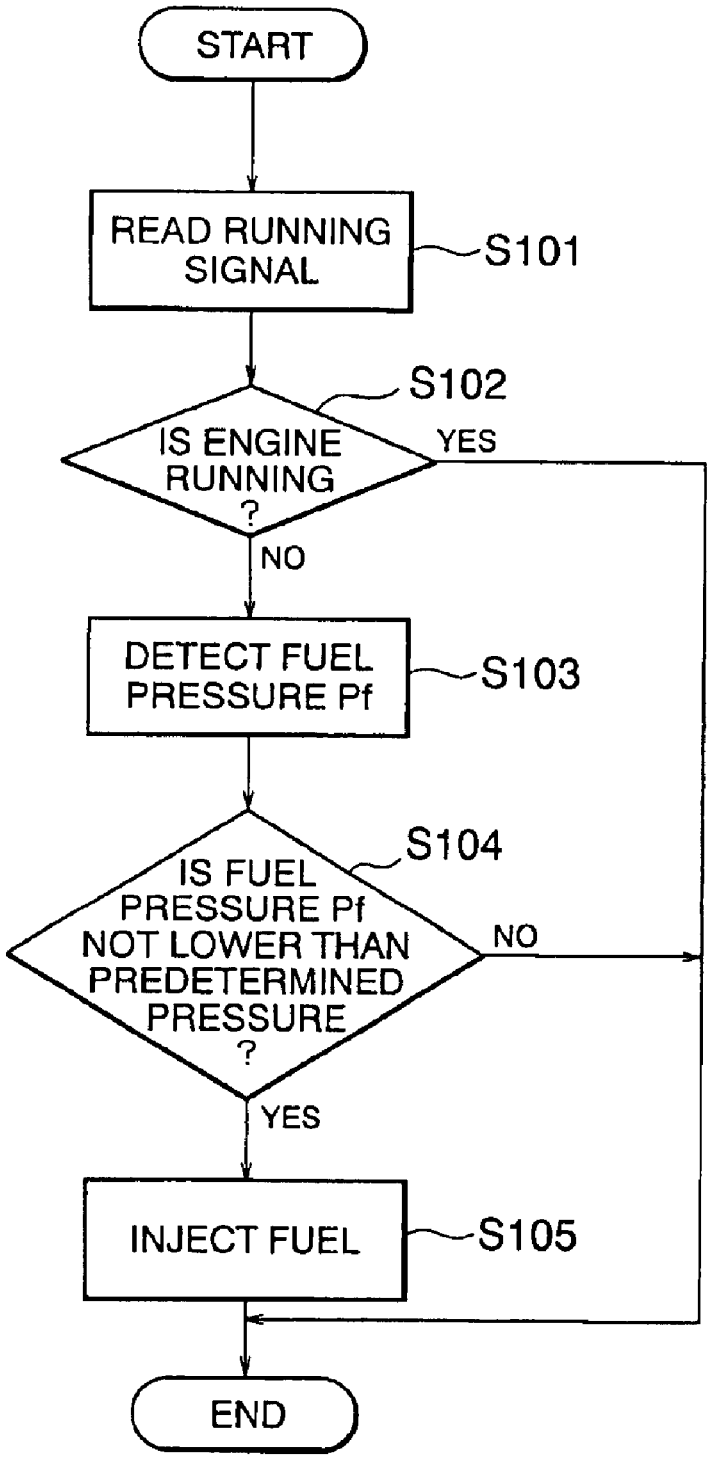
FIG. 4 is a flow chart illustrating the operation of the ECU shown in FIG. 1 when performing a control to reduce the pressure in the fuel rail.
Figure 5:
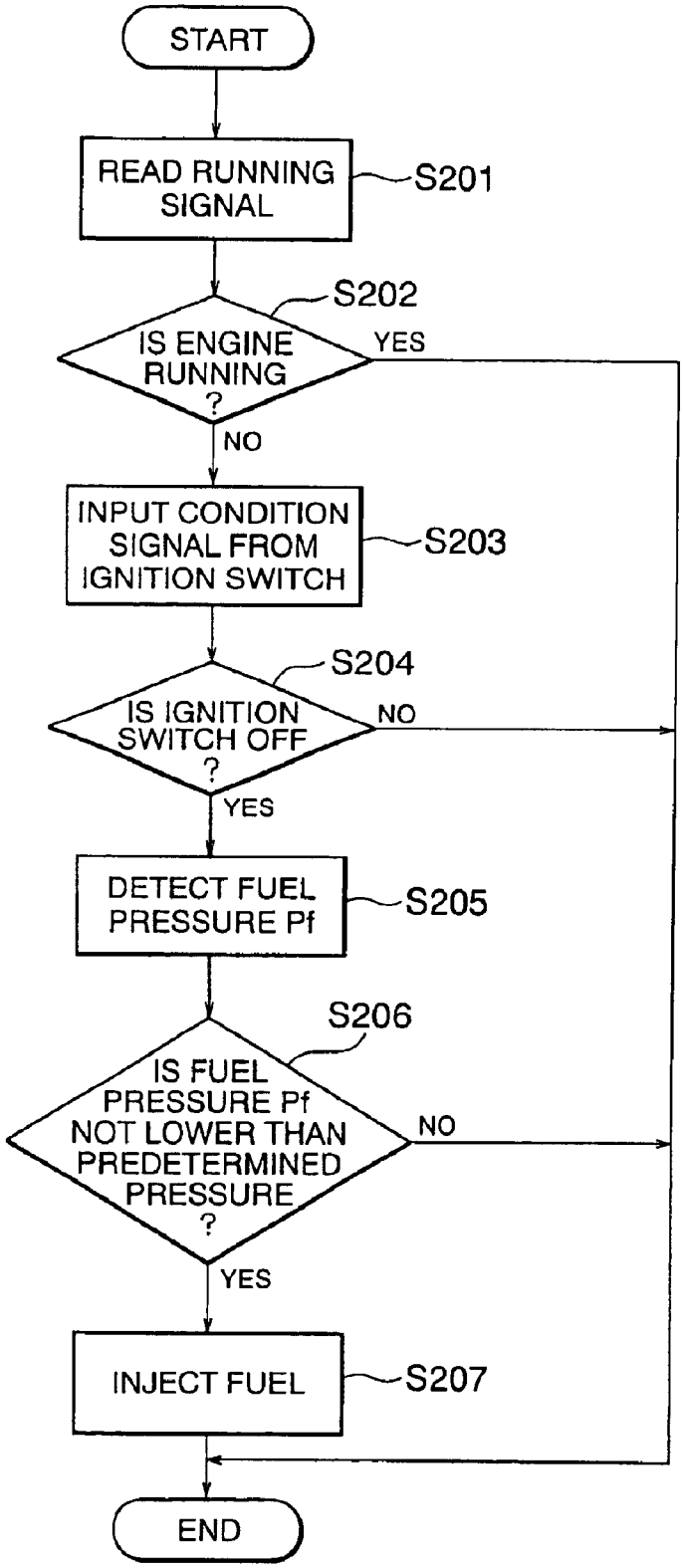
FIG. 5 is a flow chart illustrating the operation of the ECU shown in FIG. 1 when performing a control to detect the OFF state of an ignition switch to reduce the pressure in the fuel rail.
Figure 6:
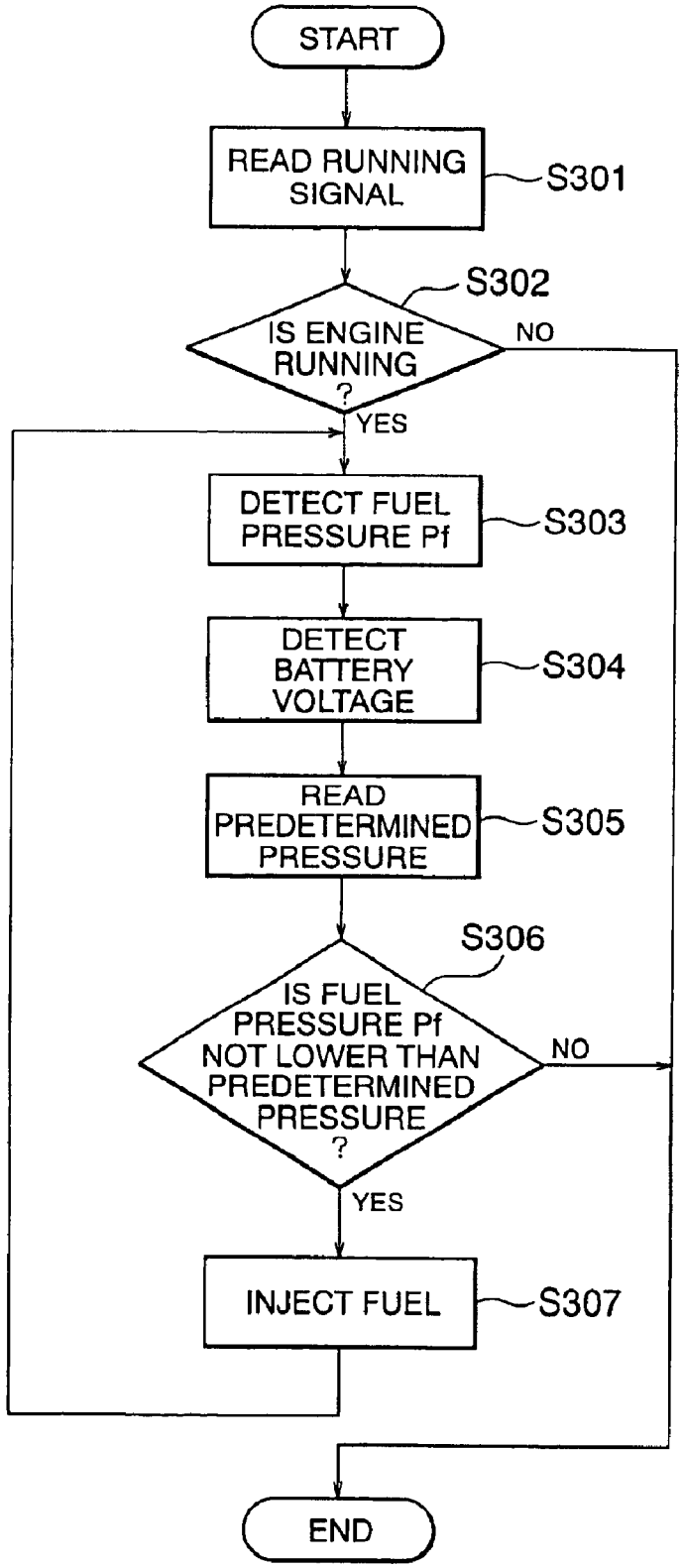
FIG. 6 is a flow chart illustrating the operation of the ECU shown in FIG. 1 when performing a control to detect the battery voltage to reduce the pressure in the fuel rail.

Next, referring to FIGS. 4, 5, and 6, the operation of the ECU 22 of the fuel supply device for the above internal combustion engine will be illustrated. FIG. 4 is a flow chart illustrating the control operation of the ECU 22 of the fuel supply device for an internal combustion engine when performing a control to lower the pressure in the fuel rail 2. Here, it is assumed that a failure has occurred during continuous energization of the discharge amount control electromagnetic valve 14. In that case, it is impossible to control the communication between the pump chamber 17 and the supply duct 3, and fuel is discharged in the maximum discharge amount Qp for the high pressure fuel pump 5. At this time, the pressure in the fuel rail 2 increases and becomes close to the valve opening pressure of the pressure control valve 18.

First, the ECU 22 reads an engine rotation signal from the crank angle sensor 24 (step S401), and judges whether the engine 100 is rotating or not based on the rotation signal (step S402).

Judging that the engine 100 is not rotating (i.e., the engine 100 at rest), the ECU 22 reads from the fuel pressure sensor 26 a fuel pressure signal for detecting the pressure in the fuel rail 2 (hereinafter referred to as "fuel pressure"), and detects the fuel pressure Pf based on this fuel pressure signal (step S103).

Next, the ECU 22 judges whether the fuel pressure Pf is a high pressure not lower than a predetermined pressure stored in the memory 22*a* (step S104).

Judging that the fuel pressure Pr is a high pressure greater than the predetermined pressure, the ECU 22 outputs a control signal to the injector 1. Then, the injector 1 inputs the control signal from the ECU 22, and injects a predetermined amount of fuel in the fuel rail 2 into the engine 100 (step S105).

Judging in S102 that the engine 100 is rotating, or judging in S104 that the fuel pressure Pr is the low pressure lower than the predetermined pressure, the ECU 22 ends the process.

This causes the fuel pressure Pf to be reduced after the engine 100 is stopped and before the restarting thereof. Accordingly, when restarting the engine 100, the fuel pressure Pf is lower than the maximum pressure Pm that can drive the injector, making it possible to avoid a situation in which the injector 1 is not driven.

FIG. 5 is a flow chart illustrating the control operation of the ECU 22 of the fuel supply device for an internal combustion engine when the ECU 22 detects the OFF state of the ignition switch 20 to reduce the fuel pressure Pf. Of the processes from steps S201 to S207, the processes other than those of steps S203 and S204 are the same as the processes from steps S101 to S105 described above. Therefore, the illustration thereof will be omitted as appropriate.

The ECU 22 reads an engine rotation signal from the crank angle sensor 24 (step S201), and judges whether the engine 100 is rotating or not based on this rotation signal (step S202).

Judging that the engine 100 is rotating, the ECU 22 inputs a condition signal (ON signal or OFF signal) from the ignition switch 20 (step S203), and, based on this condition signal, judges whether the ignition switch 20 is in the OFF state or not (step S204). Note that the OFF signal from the ignition switch 20 is an engine stop signal.

When the OFF signal from the ignition switch 20 is input, the ECU 22 judges that the ignition switch 20 is in the OFF state. Then, the ECU 22 detects the fuel pressure Pf based on the fuel pressure signal read from the fuel pressure sensor 26 (step S205), and judges whether the fuel pressure Pf is a high pressure not lower than the predetermined pressure stored in the memory 22*a* (step S206).

Judging that the fuel pressure Pf is a high pressure not lower than the predetermined pressure, the ECU 22 outputs a control signal to the injector 1, and a predetermined amount of fuel in the fuel rail 2 is injected into the engine 100 by the injector 1 (step S207).

Note that the ECU 22 ends the process when judging in S202 that the engine 100 is rotating, or judging in S204 that the ignition switch 20 is in the ON state, or judging in S206 that the fuel pressure Pf is a low pressure lower than the predetermined pressure.

Due to this arrangement, the fuel pressure Pf is lowered after the ignition switch 20 is turned OFF and before the engine 100 is restarted. Accordingly, when restarting the engine 100, the fuel pressure Pf becomes lower than the maximum pressure Pm allowing driving of the injector, avoiding a situation in which the injector 1 is not driven.

FIG. 6 is a flow chart illustrating the control operation of the ECU 22 of the fuel supply device for an internal combustion engine when the ECU 22 detects the battery voltage to lower the fuel pressure Pf. Of the processes from steps S301 through S307, the processes other than those of steps S304 and S305 are the same as the processes from steps S101 through S105. Therefore, the illustration thereof will be omitted as appropriate.

First, the ECU 22 reads an engine rotation signal from the crank angle sensor 24 (step S301), and, based on this rotation signal, judges whether the engine 100 is rotating or not (step S302). Judging that the engine 100 is rotating, the ECU 22 reads a fuel pressure signal from the fuel pressure sensor 26, and detects the fuel pressure Pf based on the fuel pressure signal (step S303).

Subsequently, the ECU 22 inputs a voltage signal from the battery 21, detects the battery voltage Vb based on this voltage signal (step S304), and reads from the memory 22*a* a predetermined pressure corresponding to this battery voltage Vb (See FIG. 3) (step S305).

Next, the ECU 22 judges whether the fuel pressure Pf detected in S303 is a high pressure not lower than a predetermined pressure read in S305 (step S306).

Judging that the fuel pressure Pf is a high pressure not lower than the predetermined pressure, the ECU 22 outputs a control signal to the injector 1, and causes a predetermined amount of fuel in the fuel rail 2 to be injected into the engine 100 by the injector 1 (step S307). Then the process proceeds to step S303. In this way, the ECU 22 repeats the processes from S303 to S307 and causes the injector 1 to continue fuel injection until the fuel pressure Pf becomes a low pressure lower than the above-mentioned predetermined pressure. Note that when judging in S302 that the engine 100 is not rotating, the ECU 22 ends the process.

This makes it possible for the ECU22 to control the fuel pressure Pf such that it does not exceed a predetermined pressure value corresponding to the battery voltage Vb. Accordingly, even if the battery voltage Vb is reduced due to a factor such as engine 100 restarting, the fuel pressure Pf becomes lower than the maximum pressure Pm allowing driving of the injector, making it possible to avoid a situation in which the injector 1 is not driven.

Embodiment 2

A fuel supply device for an internal combustion engine according to Embodiment 2 of the present invention has the same structure as that of Embodiment 1. Therefore, the illustration thereof is omitted to avoid duplication.

Figure 7:
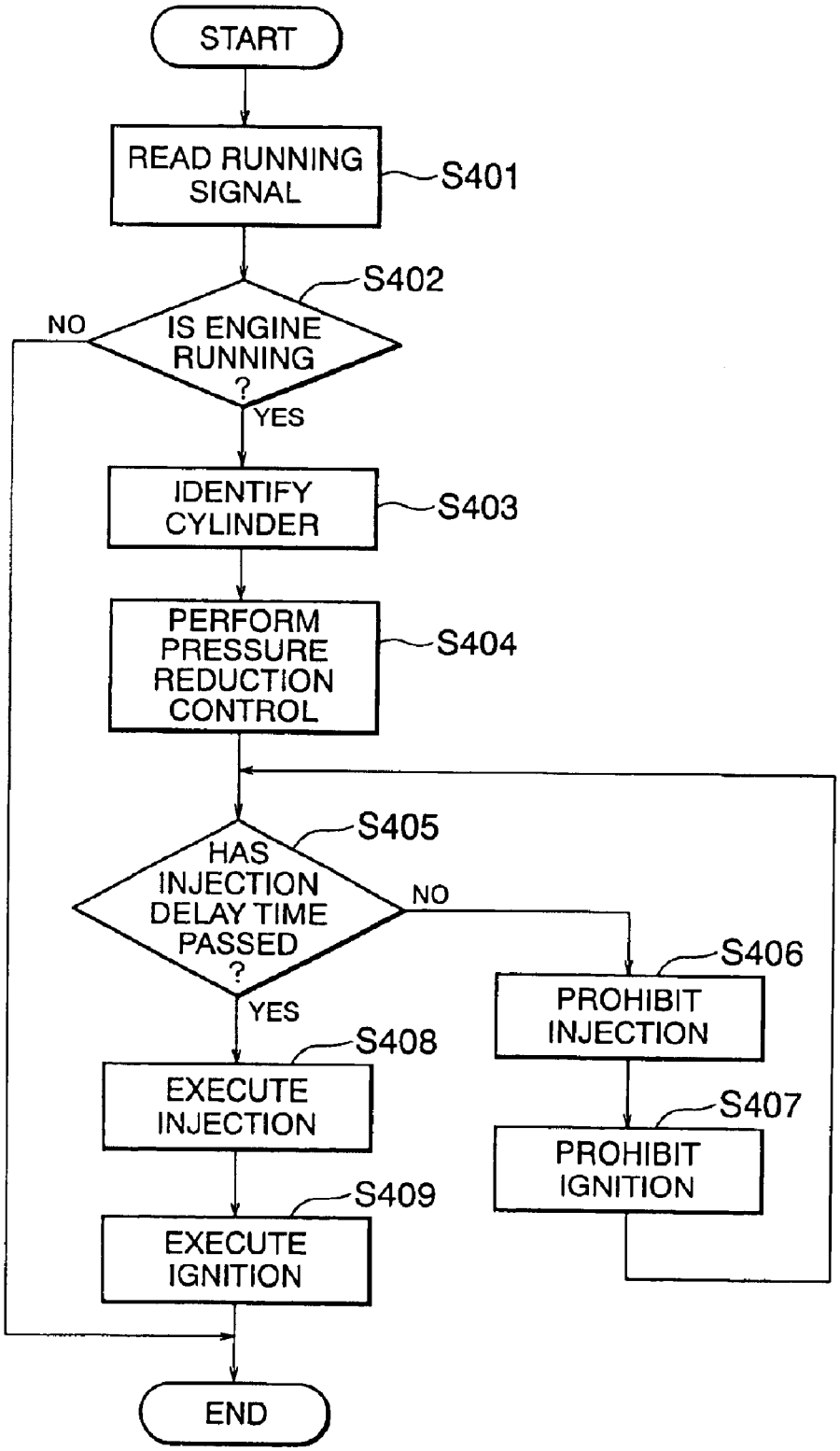
FIG. 7 is a flow chart illustrating the operation of the ECU shown in FIG. 1 when performing a control to restart the engine after performing the control to reduce the fuel pressure in the fuel rail.

Referring to FIG. 7, an operation of the ECU 22 of the fuel supply device for an internal combustion engine according to Embodiment 2 is illustrated. FIG. 7 is a flow chart illustrating the operation of the ECU 22 of the fuel supply device for an internal combustion engine when performing a control to restart the engine 100 after the control of lowering the fuel pressure Pf.

First, the ECU 22 reads an engine rotation signal from the crank angle sensor 24 (step S401), and judges whether the engine 100 is rotating or not based on the rotation signal (step S402). Judging that the engine 100 is rotating, the ECU 22 reads a cylinder discriminating signal for discriminating the cylinder 27 to which the fuel is injected by the injector 1, and, based on the cylinder discriminating signal, identifies the cylinder 27 to which the fuel injection is first performed in the identified order (step S403). Note that the ECU 22 reads the cylinder discriminating signal in, for example, a compression stroke of the cylinder 27.

Next, the ECU 22 performs the control of lowering the fuel pressure Pf (hereinafter referred to as "pressure lowering control"). The pressure lowering control indicates the processes from steps S103 to S105, S203 to S207, or S304 to S307 described above.

Then, the ECU 22 judges whether the injection delay time stored in the memory 22*a* has passed (step S405). The injection delay time is a time period for delaying the timing of the fuel injection by the injector 1, and is set, for example, to the time period that corresponds to the four strokes of intake, compression, and so on. Note that the ECU 22 uses a timer (not shown) when making the judgment in step S405.

Judging in step S405 that the injection delay time has not passed, the ECU 22 prohibits the injector 1 from injecting high pressure fuel (step S406), and prohibits the ignition of the cylinders 27 (step S407). Then the process proceeds to step S405. In that case, the ECU 22 does not output the control signal to the injector 1, for example. The ECU 22 repeats the processes from step S405 to step S407 until the injection delay time has passed.

Judging that the injection delay time has passed in step S405, the ECU 22 outputs the control signal to the injector 1, causing the injector 1 to inject fuel (step S408) and to ignite the cylinders 27 in the order identified in step S403 (step S409). Note that the ECU 22 ends the process when judging at the step S402 that the engine 100 is not rotating.

In this way, the ECU 22 delays the timing of starting the fuel injection by the injector 1 by a predetermined period of time when restarting the engine 100 after fuel is injected into the stopped engine 100 (the engine that is completely stopped, or close to that state). This means that the fuel is injected after the air fuel mixture remaining in the fuel chamber is cleared. For example, the fuel is injected after the air fuel mixture flowing into the intake pipe or the air fuel mixture remaining in the fuel chamber is cleared, in the order of cylinders 27 not ignited in the intake stroke. Accordingly, it is possible to smoothly restart the engine 100 with an appropriate amount of fuel required for the restarting.

Further, when performing ignition control of the cylinders 27 associated with the injector 1 after the injector 1 injects fuel with a predetermined time delay, the ECU 22 performs ignition control of the cylinders 27 in the order in which the cylinders 27 are injected with fuel by the injector 1. This can avoid a non favorable situation in which the cylinder 27 to which fuel is not injected is ignited with the residual air fuel mixture, which deteriorates the operating characteristics at the time of restarting.

Note that, while in Embodiment 2 the ECU performs fuel injection and ignition control by judging whether the injection delay time has passed or not, the present invention is not limited thereto. The ECU 22 may, for example, use a counter when performing the above fuel injection and ignition control. In that case, the ECU 22 adds up counter values one by one at each engine stroke, and performs control to prohibit the fuel injection and ignition during a period of time until the counter value has changed from the initial value (for example, zero) to the final value (for example, four). In this way, the timing of restarting the fuel injection by the injector 1 may be delayed by a predetermined period of time.

Embodiment 3

A fuel supply device for an internal combustion engine according to Embodiment 3 of the present invention has the same structure as that of Embodiment 1. Therefore, the illustration thereof is omitted to avoid duplication.

Figure 8:
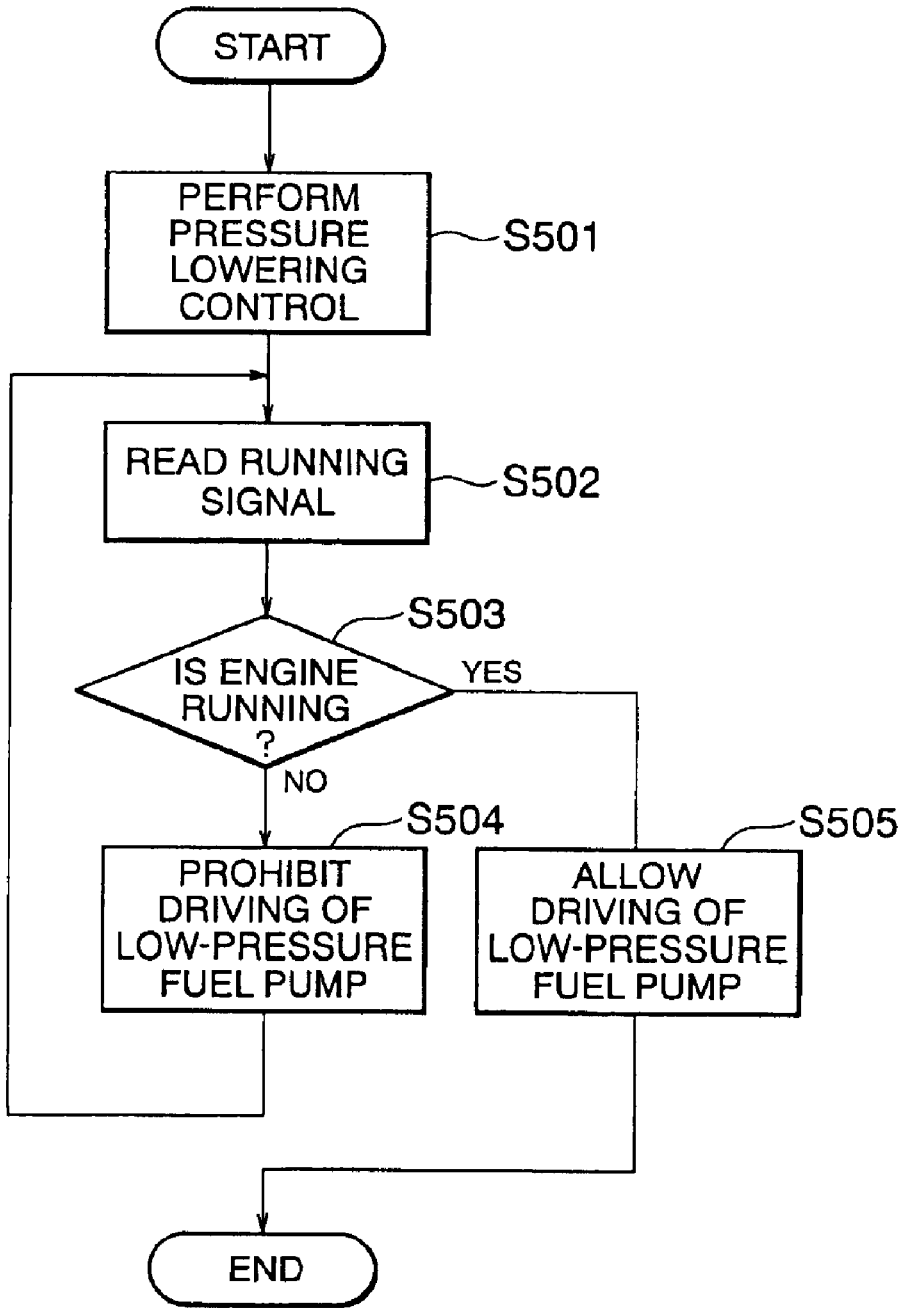
FIG. 8 is a flow chart illustrating the operation of the ECU shown in FIG. 1 when performing a control to prohibit the driving of a low pressure fuel pump after the engine is stopped.

Referring to FIG. 8, an operation of the ECU 22 of the fuel supply device for an internal combustion engine according to Embodiment 3 is illustrated. FIG. 8 is a flow chart illustrating the operation of the ECU 22 of the fuel supply device for an internal combustion engine when performing a control to prohibit the driving of a low pressure fuel pump after the engine 100 is stopped.

First, the ECU 22 performs a pressure lowering control after the engine 100 is stopped (step S501). The pressure lowering control indicates the processes from steps S103 to S105, S203 to S207, or S304 to S307 described above. Next, the ECU 22 reads the engine rotation signal from the crank angle sensor 24 (step S502), and judges whether the engine 100 is rotating or not based on the rotation signal (step S503).

Judging that the engine 100 is not rotating (the engine at rest), the ECU 22 prohibits the driving of the low pressure fuel pump 7 (step S504), and the process proceeds to the step S502. In that case, the ECU 22 does not output the control signal to the injector 1, for example.

By this operation, the pressure control valve 18 stays open while the engine 100 is stopped, and the fuel accumulated in the fuel rail 2 is returned to the low pressure piping 9 by way of the low pressure passage 19. Accordingly, the lowering of the fuel pressure Pf is accelerated while the engine 100 is stopped.

Judging that the engine 100 is rotating (the engine is restarted), the ECU 22 then outputs a control signal to the low pressure fuel pump 7 to allow the driving thereof (step S505).

In this way, the ECU 22 prohibits the driving of the low pressure pump 7 in order to promote the back-pressure of the fuel remaining within the fuel rail 2 to act on the high pressure fuel pump 5 through the pressure control valve 18, during a period of time after the fuel within the fuel rail 2 is injected into the stopped engine 100 until the engine 100 is restarted. Accordingly, it is possible to increase the amount of fuel that leaks naturally through the pressure control valve 18 after the engine 100 is stopped until the engine 100 is restarted, thereby accelerating the lowering of the fuel pressure Pf while the engine 100 is stopped.

Further, the ECU 22 controls the driving of the low pressure fuel pump 7 based on whether the engine 100 is rotating or not. Accordingly, the lowering of the fuel pressure Pf can be accelerated as compared with the system where the low pressure fuel pump 7 is driven when the ignition switch 20 is turned ON.

What is claimed is:

1. A fuel supply device for an internal combustion engine comprising a control means for controlling an injector for injecting fuel in a fuel rail to control an amount of fuel to be injected into an engine 100, wherein, when the pressure in the fuel rail is a high pressure greater than a maximum pressure that can drive the injector and the engine 100 is stopped, the control means opens the injector to inject the high pressure fuel in the fuel rail into the stopped engine.

2. A fuel supply device for an internal combustion engine according to claim 1, wherein the control means opens the injector on condition that a stop signal for the engine has been input from a starting device.

3. A fuel supply device for an internal combustion engine according to claim 1, wherein, when injecting fuel into the stopped engine, the control means detects a voltage of a battery supplying power to the injector, reads from a memory the maximum pressure that can drive the injector corresponding to this voltage, and causes the injector to continue to inject fuel until this maximum pressure becomes higher than the pressure in the fuel rail.

4. A fuel supply device for an internal combustion engine according to claim 1, wherein, when the stopped engine is restarted after injecting fuel into the stopped engine, the control means delays timing of starting the fuel injection by the injector by a predetermined period of time.

5. A fuel supply device for an internal combustion engine according to claim 4, wherein, when performing an ignition control on cylinders 27 associated with the injector after the fuel injection by the injector delayed by a predetermined period of time, the control means performs ignition control in the order in which the cylinders 27 are injected with fuel by the injector.

6. A fuel supply device for an internal combustion engine according to claim 1, wherein, after fuel in the fuel rail is injected into the stopped engine and before the engine is restarted, the control means prohibits driving of a low pressure pump that supplies fuel to a high pressure fuel pump in order to promote back-pressure of the fuel remaining within the fuel rail to act on the high pressure pump side through a pressure control valve.

* * * * *